US006427669B1

(12) United States Patent
Hadler

(10) Patent No.: US 6,427,669 B1
(45) Date of Patent: Aug. 6, 2002

(54) ACTUATORS FOR PUMP-NOZZLE-INJECTION ELEMENTS OR INJECTION PUMPS FOR INTERNAL COMBUSTION ENGINES

(75) Inventor: Jens Hadler, Gifhorn (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 09/889,012

(22) PCT Filed: Dec. 23, 1999

(86) PCT No.: PCT/EP99/10345

§ 371 (c)(1),
(2), (4) Date: Jul. 9, 2001

(87) PCT Pub. No.: WO00/40853

PCT Pub. Date: Jul. 13, 2000

(30) Foreign Application Priority Data

Jan. 8, 1999 (DE) ..... 199 00 499

(51) Int. Cl.[7] ..... F02M 39/02; F02M 59/10

(52) U.S. Cl. ..... 123/508; 123/90.31; 123/90.6

(58) Field of Search ..... 123/496, 507, 123/508, 509, 90.15, 90.17, 90.31, 90.6

(56) References Cited

U.S. PATENT DOCUMENTS

| | | | | |
|---|---|---|---|---|
| 5,159,904 A | | 11/1992 | Ingold | 123/90.15 |
| 5,307,781 A | * | 5/1994 | Nakada et al. | 123/495 |
| 5,823,168 A | * | 10/1998 | Otoh et al. | 123/496 |
| 5,899,181 A | * | 5/1999 | Kurata et al. | 123/90.17 |

FOREIGN PATENT DOCUMENTS

| | | |
|---|---|---|
| DE | 579 557 | 6/1933 |
| DE | 70 12 067 | 10/1970 |
| DE | 31 46 875 | 8/1982 |
| DE | 38 23 107 | 3/1989 |
| DE | 39 28 104 | 3/1990 |
| DE | 40 26 013 | 2/1992 |
| DE | 689 01 803 | 1/1993 |
| DE | 42 32 783 | 1/1994 |
| EP | 0 011 611 | 5/1980 |
| GB | 2 090 911 | 7/1982 |

* cited by examiner

*Primary Examiner*—Weilun Lo
(74) *Attorney, Agent, or Firm*—Cohen, Pontani, Lieberman & Pavane

(57) ABSTRACT

A drive for pump-nozzle injection elements and injection pumps of an internal combustion engine. The drive includes a crankshaft, a camshaft for actuating the injection elements, and form-locking traction member for drivingly connecting the crankshaft to the to the camshaft so that torque angles change in a synchronous manner. The camshaft has cams which are optimized in each case for an injection process with respect to stroke velocity and thus feed rate of fuel. The cams are configured so that the torque angle or a range of torque angles ($\alpha_{VHmax}$) before TDC of the cams at which the cams produce a maximum fuel feed rate deviates by an angle $\alpha_a$ from an optimum angle before TDC (K). An amount by which the angle deviates from the optimum angle in a direction toward TDC is no more than an angular error ($\alpha_F$) resulting from an increase in length of the traction means during operation.

3 Claims, 2 Drawing Sheets

ACTUATORS FOR PUMP-NOZZLE-INJECTION ELEMENTS OR INJECTION PUMPS FOR INTERNAL COMBUSTION ENGINES

BACKGROUND OF THE INVENTION

The invention pertains to drives for pump-nozzle injection elements or injection pumps for internal combustion engines.

Drives of the general type in question for pump-nozzle injection elements of internal combustion engines with a camshaft, driven by a crankshaft via a form-locking traction means, e.g., a timing belt or chain, so that the torque angles change in synchrony for the actuation of the pump-nozzle injection elements, are known.

The optimum nominal output of an engine is achieved when the fuel is delivered at the fastest rate at a certain angle before top dead center of the compression stroke; the optimum maximum torque, however, is achieved at a different maximum fuel feed rate angle (FIG. 3). The reason for this is that the course of the combustion process is determined qualitatively for the most part by the point in time at which the largest specific amount of fuel is injected with optimum atomization.

It is already known that an angle-adjusting device can be installed in the drive between the crankshaft and the camshaft to set the area of maximum stroke velocity of the cams to the optimum angular position. This is precisely what the injection timing mechanisms already used in injection pumps and pump-nozzle units do. In the case of drives without an injection timing mechanism, the angle before top dead center of the compression stroke at which the area of the cam which produces the maximum stroke velocity is set represents a compromise, so that both a high torque and a high nominal output are achieved.

In drives of this type with a form-locking traction means, the traction means, such as a timing belt or chain, stretches to a certain extent, depending on the load and the length of time it has been in service.

As a result, the angular relationship between the crankshaft and the camshaft set at the factory shifts in the direction of a greater angular distance before top dead center. This usually leads to a loss of power in the operating range where nominal output is obtained.

Under the influence of the torque which actuates the fuel feed element, the camshaft of the drive also twists, and thus, the farther the cam is from the drive plane of the camshaft, the greater the elastic twist of the camshaft. The angle of this rotation also leads to an increase in the angle before TDC in comparison with the angle between the crankshaft and the camshaft set at the factory. This leads to the previously described loss of power.

SUMMARY OF THE INVENTION

The invention is based on the task of designing a drive of the general type in question without an injection timing mechanism for pump-nozzle injection elements and injection pumps in such a way that long-term changes in the traction means and in the load-dependent twist of the camshaft have hardly any effect on the nominal output.

This is achieved according to the invention in that the torque angle or range of torque angles before TDC of the cams at which they produce the maximum feed rate deviates from the optimum angle before TDC. The amount by which this angle deviates from the optimum angle is equal to or less than the angular error resulting from the increase in the length of the traction means. By the use of a design such as this, it is possible. to keep both the nominal output and also the maximum torque at nearly constant values.

The use of an injection timing mechanism or the periodic readjustment of the angle between the camshaft and the crankshaft during the operating life of the drive can therefore be eliminated.

In a similar way, it is also possible according to the invention to compensate for the effects of torque on the actuation of the fuel feed element, i.e., the effects which result from the elastic twisting of the camshaft of the drive. Details on this aspect are provided in the proper context of the following description.

DETAILED DESCRIPTION OF THE PREFERRED EMBODIMENTS

Figure 1A:
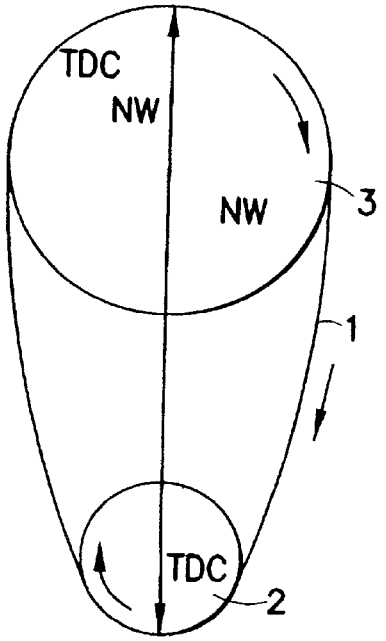
FIG. 1*a* and 1*b* show drives for pump-nozzle injection elements or injection pumps with a new and a stretched traction means.
Figure 2:
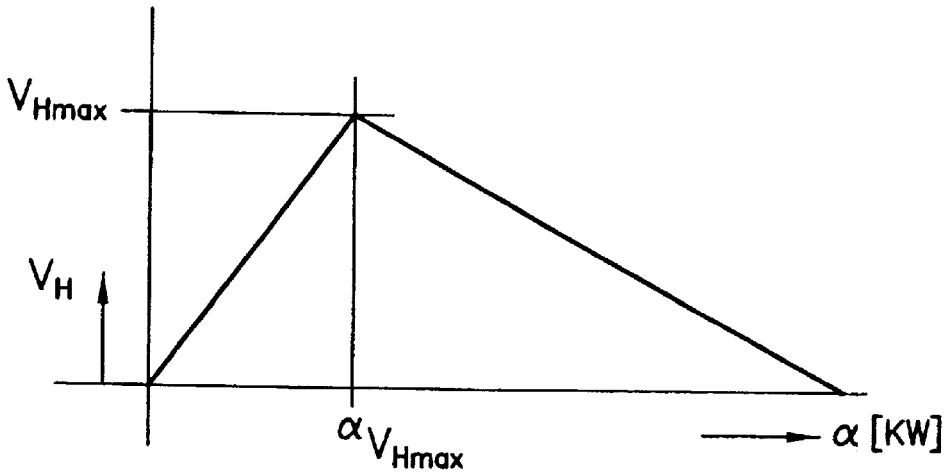
FIG. 2 shows a characteristic diagram of the stroke velocity of a cam in cooperation with the transfer means.
Figure 4:
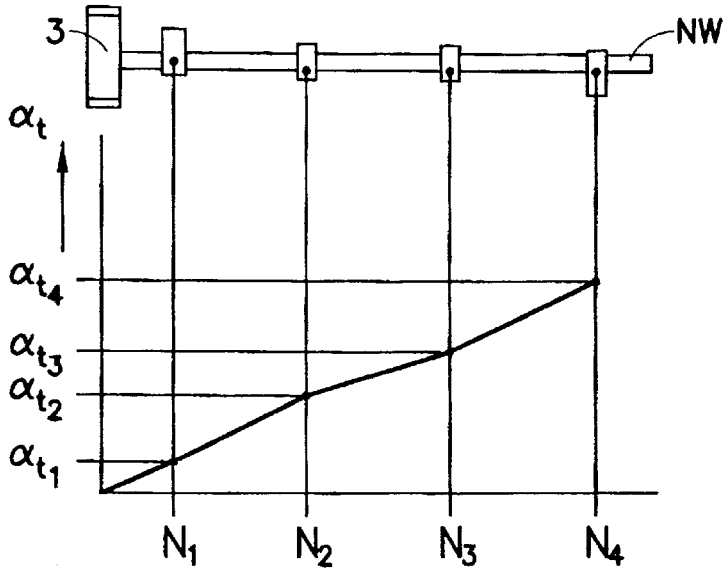
FIG. 4 shows a diagram of the elastic twist of the camshaft NW at the times that the cams $N_1$–$N_4$ are in action.

FIG. 1*a* shows a schematic diagram of a drive for pump-nozzle injection elements or injection pumps. From the crankshaft KW of the internal combustion engine, a positive, form-locking traction means 1 drives a camshaft NW via the gear wheels 2, 3 so that the torque angles change in a synchronous manner. The cams $N_1$–$N_4$ of the camshaft (see FIG. 4) engage with the actuating parts of the injection elements (not shown). The cams $N_1$–$N_4$ of the camshaft NW are optimized for the injection process; that is, they have a pronounced maximum torque angle or a very narrow range of maximum torque angles at the point of high stroke velocity $V_{Hmax}$ and thus at the point of high fuel feed rate (see FIG. 2).

Figure 3:
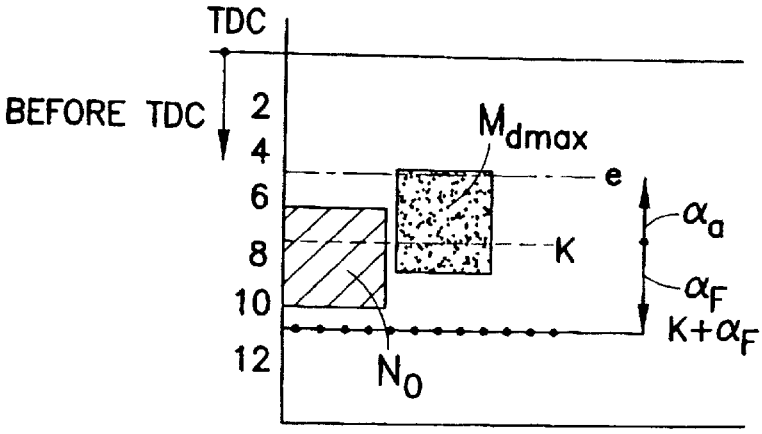
FIG. 3 shows a characteristic diagram of the maximum feed rate $V_{Hmax}$ for optimum nominal output $N_0$ and maximum torque $M_{dmax}$.

The torque angle or torque angle range $V_{Hmax}$ before top dead center of the compression stroke at which optimum nominal output (field $N_0$) is obtained can be different from the angle or range of angles in which optimum, maximum torque (field $M_{dmax}$) is obtained (see the indicated fields in FIG. 3). The reason for this is that the course of the combustion process is determined qualitatively for the most part by the time at which the largest specific amount of fuel is injected wit optimum atomization.

In the case of drives to be designed according to the invention without an injection timing mechanism, the torque angle or torque angle range $V_{Hmax}$ is set at a fixed point before top dead center of the compression stroke (see FIG. 3, line K); this angle K represents a compromise, which allows both high torque and also high nominal output to be obtained. The location of the torque angles or torque angle ranges $V_{Hmax}$ of the cams before TDC for achieving high torque $M_{dmax}$ and their location for achieving high nominal output $N_0$ are shown in FIG. 3.

Figure 1B:
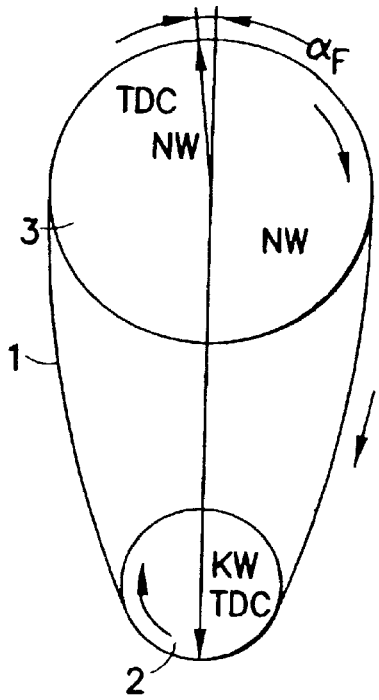

In the case of drives with a positive, form-locking traction means 1, e.g., a timing belt or a chain, permanent increases in length L occur as a function of load and operating time. These increases shift the fixed angle between the crankshaft KW and the camshaft NW originally set at the factory (see FIG. 1*a*) toward an angle which is larger by $a_F$ (see FIG. 1*b*). This usually leads to a loss of power in the nominal output operating range; see FIG. 3, line K+$\alpha_F$.

The power loss occurring as a result of the increase L in the length of the form-locking traction means 1 is avoidable. According to the invention, the torque angle or torque angle range of the cams $N_1$–$N_4$ is set closer to TDC by an amount $\alpha$a (see line e in FIG. 3) than the theoretically optimum position before TDC (see line K in FIG. 3). The deviation represented by angle $\alpha_F$ corresponds to the error caused by the length increase L. Line e in FIG. 3 characterizes a setting according to the invention.

As a result of the torque which acts during the actuation of the fuel feed elements, the camshaft NW is subject to elastic twist, and the farther the cam $N_1$–$N_4$ in question is away from the drive wheel 3 or from the drive plane of the camshaft NW, the greater are the twist angles $\alpha t_1$–$\alpha t_4$ which can occur. This twist angle at also increases the torque angle or torque angle range $\alpha_{VHmax}$ before TDC at which maximum stroke velocity is obtained in comparison with the angle between the crankshaft KW and the cam shaft NW set originally at the factory. These twist angles at therefore also have the effect of decreasing the power of the engine.

These effects can be eliminated according to the invention. For this purpose, the cams N are set closer to TDC by an angle $\alpha_a$' and thus arrive at a point different from that corresponding to the angle $\alpha_z$ which separates one cylinder from the next. The difference angle $\alpha_t$ with respect to the position corresponding to the cylinder separation angle $\alpha_z$ is determined by the elastic twist between the drive wheel 3 and the associated cams $N_1$–$N_4$. Its value is equal to the twist, expressed as angle $\alpha_t$, which occurs at full load and maximum stroke velocity.

Figure 5:
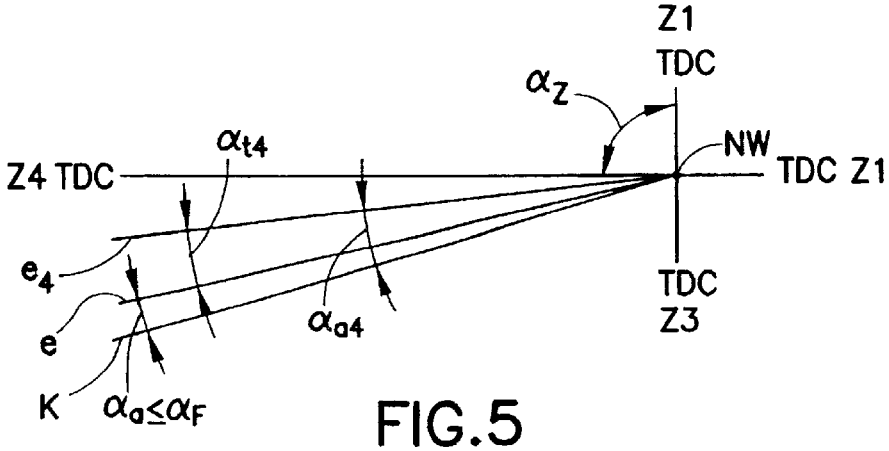
FIG. 5 shows how a cam is mounted on the camshaft NW according to the invention.

To compensate for the increase L in the length of the traction means 1 and also for the twist $\alpha_t$ of the camshaft NW during the fuel feed process of the individual pump-nozzle elements, the torque angles Or torque angle ranges $\alpha_{VHmax}$ of all the cams $N_1$–$N_4$ on the camshaft NW are therefore set closer to TDC by an angle of, for example, $\alpha_a$' (see ray e'), which deviates from the theoretically optimum position before TDC (see ray K). FIG. 5 shows the previously described angular corrections for cylinder Z4.

In the design described above, the cams $N_1$–$N_4$ are arranged with respect to each other on the camshaft NW at angles which differ from the cylinder separation angle $\alpha_z$ and which bring them closer to TDC. The difference angle at with respect to the angular position corresponding to the cylinder separation angle $\alpha_z$ is determined by the elastic twist which occurs between the drive wheel 3 and the associated cam $N_1$–$N_4$.

In another embodiment of the invention, during the entire life of the traction means, all the pump-nozzle elements are actuated by the cams $N_1$–$N_4$ driven by the traction means 1 in such a why that the torque angle or torque angle range $\alpha_{VHmax}$ for each cylinder Z1–Z4 is always closer to TDC by an angle $\alpha_a$' and thus in a position in which the engine delivers optimum nominal output.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A drive for pump-nozzle injection elements and injection pumps of an internal combustion engine, comprising: a crankshaft; a camshaft for actuating the injection elements; and form-locking traction means for drivingly connecting the crankshaft to the camshaft so that torque angles change in a synchronous manner, the camshaft having cams which are optimized in each case for an injection process with respect to stroke velocity and thus feed rate of fuel, the cams being configured so that the torque angle or a range of torque angles ($\alpha_{VHmax}$) before TDC of the cams at which the cams produce a maximum fuel feed rate deviates by an angle $\alpha_a$ from an optimum angle before TDC (K), an amount by which the angle deviates from the optimum angle in a direction toward TDC is no more than an angular error ($\alpha_F$) resulting from an increase in length of the traction means during operation.

2. A drive for pump-nozzle injection elements and injection pumps of an internal combustion engine having cylinders, comprising: a crankshaft; a camshaft for actuating the injection elements; and form-locking traction means for drivingly connecting the crankshaft to the camshaft so that torque angles change in a synchronous manner, the camshaft having a drive wheel, and further having cams which are optimized in each case for an injection process with respect to stroke velocity and thus feed rate of fuel, the cams being configured so that the angles of the cams ($N_1$–$N_4$) differ from an angle ($\alpha_z$) which separates the cylinders from each other so as to bring the cams closer to TDC, the difference angles ($\alpha_{t1}$–$\alpha_{t4}$) with respect to the angle corresponding to the cylinder separation angle ($\alpha_z$) are determined by elastic twist between the drive wheel and the cam ($N_1$–$N_4$) which occurs at full load and maximum fuel feed rate ($V_{Hmax}$).

3. A drive according to claim 1, wherein the angles of the cams ($N_1$–$N_4$) differ from an angle ($\alpha_z$) which separates the cylinders from each other so as to bring the cams closer to TDC, the difference angles ($\alpha_{t1}$–$\alpha_{t4}$) with respect to the angle corresponding to the cylinder separation angle ($\alpha_z$) are determined by elastic twist between the drive wheel and the cams ($N_1$–$N_4$) which occurs at full load and maximum fuel feed rate ($V_{Hmax}$), the angles or angle ranges ($V_{Hmax}$) of maximum feed rate of the cams ($N_1$–$N_4$) are closer to TDC than a theoretically optimum position before TDC by certain angles of deviation ($\alpha_{a'1}\alpha_{a'4}$), wherein in each case the angle of deviation ($\alpha_{a'}$) is equal to a sum of the angular error ($\alpha_f$) resulting from the stretching of the traction means and the difference angle ($\alpha_{t1}\alpha_{t4}$) which occurs at full load and maximum fuel feed rate ($V_{Hmax}$).

* * * * *